US011686523B2

(12) United States Patent
Meza Silva et al.

(10) Patent No.: US 11,686,523 B2
(45) Date of Patent: Jun. 27, 2023

(54) REFRIGERATION UNIT

(71) Applicant: WHIRLPOOL CORPORATION, Benton Harbor, MI (US)

(72) Inventors: Juan Pablo Meza Silva, Apodaca (MX); Hector Torres Gonzalez, Apodaca (MX)

(73) Assignee: Whirlpool Corporation, Benton Harbor, MI (US)

( * ) Notice: Subject to any disclaimer, the term of this patent is extended or adjusted under 35 U.S.C. 154(b) by 183 days.

(21) Appl. No.: 17/091,519

(22) Filed: Nov. 6, 2020

(65) Prior Publication Data

US 2022/0146183 A1 May 12, 2022

(51) Int. Cl.

| | |
|---|---|
| ***F25D 23/00*** | (2006.01) |
| ***F25B 39/02*** | (2006.01) |
| ***F25D 21/08*** | (2006.01) |
| ***F28F 9/013*** | (2006.01) |

(52) U.S. Cl.

CPC ..... *F25D 23/006* (2013.01); *F25B 39/02* (2013.01); *F25D 21/08* (2013.01); *F28F 9/0137* (2013.01); *F25B 2339/02* (2013.01); *F25D 2321/00* (2013.01)

(58) Field of Classification Search

CPC ..... F25D 21/08; F25B 39/02

See application file for complete search history.

(56) References Cited

U.S. PATENT DOCUMENTS

| | | | | |
|---|---|---|---|---|
| 2,922,017 | A * | 1/1960 | Ripley | F24C 7/06 338/315 |
| 3,588,151 | A * | 6/1971 | Korenz | F25D 21/08 403/397 |
| 3,678,698 | A * | 7/1972 | Gelbard | F25B 39/02 62/515 |
| 3,783,635 | A * | 1/1974 | Perez | F16B 7/0433 219/532 |
| 3,786,227 | A * | 1/1974 | Seipp | H05B 3/00 392/480 |
| 4,580,623 | A * | 4/1986 | Smitte | F25D 21/08 165/182 |
| 4,716,275 | A * | 12/1987 | Waldschmidt | F25D 21/08 338/315 |
| 4,756,358 | A * | 7/1988 | O'Neal | F25D 21/08 62/275 |
| 4,766,736 | A * | 8/1988 | Waldschmidt | F25D 21/08 62/298 |
| 5,016,706 | A | 5/1991 | Dimarco et al. | |
| 9,874,403 | B2 * | 1/2018 | Candeo | F28F 9/002 |
| 10,041,738 | B2 | 8/2018 | Candeo | |
| 10,254,038 | B2 * | 4/2019 | Jung | F25D 21/14 |

(Continued)

FOREIGN PATENT DOCUMENTS

| | | |
|---|---|---|
| CN | 109708357 A | 5/2019 |
| CN | 210832619 U | 6/2020 |

(Continued)

*Primary Examiner* — Christopher R Zerphey

(74) *Attorney, Agent, or Firm* — Price Heneveld LLP

(57) ABSTRACT

A refrigeration unit having an evaporator tube, a heater tube in a spaced relationship with the evaporator tube, a wire that couples the evaporator tube to the heater tube, and a bracket having a first panel configured to contact the heater tube and a second panel that defines a recess configured to receive the heater tube therein.

19 Claims, 5 Drawing Sheets

(56) References Cited

U.S. PATENT DOCUMENTS

| | | | | |
|---|---|---|---|---|
| 10,436,497 | B2 | 10/2019 | Kriegsmann | |
| 10,451,331 | B2 | 10/2019 | Shin | |
| 10,612,857 | B2 | 4/2020 | Candeo | |
| 2011/0138834 | A1* | 6/2011 | Maeda | F25D 21/08 62/275 |
| 2013/0081415 | A1 | 4/2013 | Kim | |

FOREIGN PATENT DOCUMENTS

| | | | |
|---|---|---|---|
| KR | 20010081285 | A | 8/2001 |
| KR | 20050077878 | A | 8/2005 |
| KR | 100817939 | B1 | 3/2008 |
| WO | 2009074495 | A1 | 6/2009 |
| WO | 2013088462 | A1 | 6/2013 |

* cited by examiner

REFRIGERATION UNIT

BACKGROUND OF THE DISCLOSURE

The present disclosure generally relates to a refrigeration unit and, more specifically, to a wire and bracket for maintaining a spaced relationship between a heater tube and an evaporator tube of a refrigeration unit.

SUMMARY OF THE DISCLOSURE

According to one aspect of the present disclosure, a refrigeration unit is disclosed. The refrigeration unit includes a serpentine evaporator tube having a plurality of elongated portions and a plurality of U-shaped bends that connect the elongated portions, a heater tube in a spaced relationship with the serpentine evaporator tube, a wire that couples the at least one elongated portion of the serpentine evaporator tube to the bottom portion of the heater tube, and a bracket. The heater tube includes a bottom portion that extends generally parallel to at least one of the plurality of elongated portions and a side portion that extends upward from the bottom portion generally perpendicular to the at least one elongated portion. The wire includes a first evaporator tube receiving section that wraps about a portion of a circumference of the at least one elongated portion of the serpentine evaporator tube, a first heater tube receiving section that wraps about a portion of a circumference of the bottom portion of the heater tube, and a first spacer section that extends between the first evaporator tube receiving section and the first heater tube receiving section and is configured to inhibit movement of the first evaporator tube receiving section relative to the first heater tube receiving section. The first evaporator tube receiving section contacts the at least one elongated portion of the serpentine evaporator tube and the first heater tube receiving section contacts the bottom portion of the heater tube, such that movement of the bottom portion of the heater tube toward and away from the at least one elongated portion of the serpentine evaporator tube is inhibited. The bracket includes a first panel that extends from a corner to a contact surface that is distal from the corner and configured to contact the side portion of the heater tube and a second panel that extends outward from the corner. The second panel defines at least one aperture configured to receive at least one of the plurality of U-shaped bends of the serpentine evaporator tube there through and a recess configured to receive the bottom portion of the heater tube therein.

According to another aspect of the present disclosure, a wire for coupling an evaporator tube to a heater tube is disclosed. The wire includes a first evaporator tube receiving section configured to wrap about a portion of a circumference of said evaporator tube, a first heater tube receiving section configured to wrap about a portion of a circumference of said heater tube, and a first spacer section that extends between the first evaporator tube receiving section and the first heater tube receiving section and inhibits movement of the first evaporator tube receiving section relative to the first heater tube receiving section. The first evaporator tube receiving section is configured to contact said evaporator tube and the first heater tube receiving section is configured to contact said heater tube, such that movement of said heater tube toward and away from said evaporator tube is inhibited.

According to yet another aspect of the present disclosure, a refrigeration unit is disclosed. The refrigeration unit includes a serpentine evaporator tube having a plurality of elongated portions and a plurality of U-shaped bends that connect the elongated portions, a heater tube in a spaced relationship with the serpentine evaporator tube, and a bracket. The heater tube includes a bottom portion that extends generally parallel to at least one of the plurality of elongated portions and a side portion that extends upward from the bottom portion generally perpendicular to the at least one elongated portion. The bracket includes a first panel that extends from a corner to a contact surface that is distal from the corner and configured to contact the side portion of the heater tube and a second panel that extends outward from the corner. The second panel defines at least one aperture configured to receive at least one of the plurality of U-shaped bends of the serpentine evaporator tube there through, and a recess configured to receive the bottom portion of the heater tube therein.

These and other features, advantages, and objects of the present disclosure will be further understood and appreciated by those skilled in the art by reference to the following specification, claims, and appended drawings.

Figure 1:
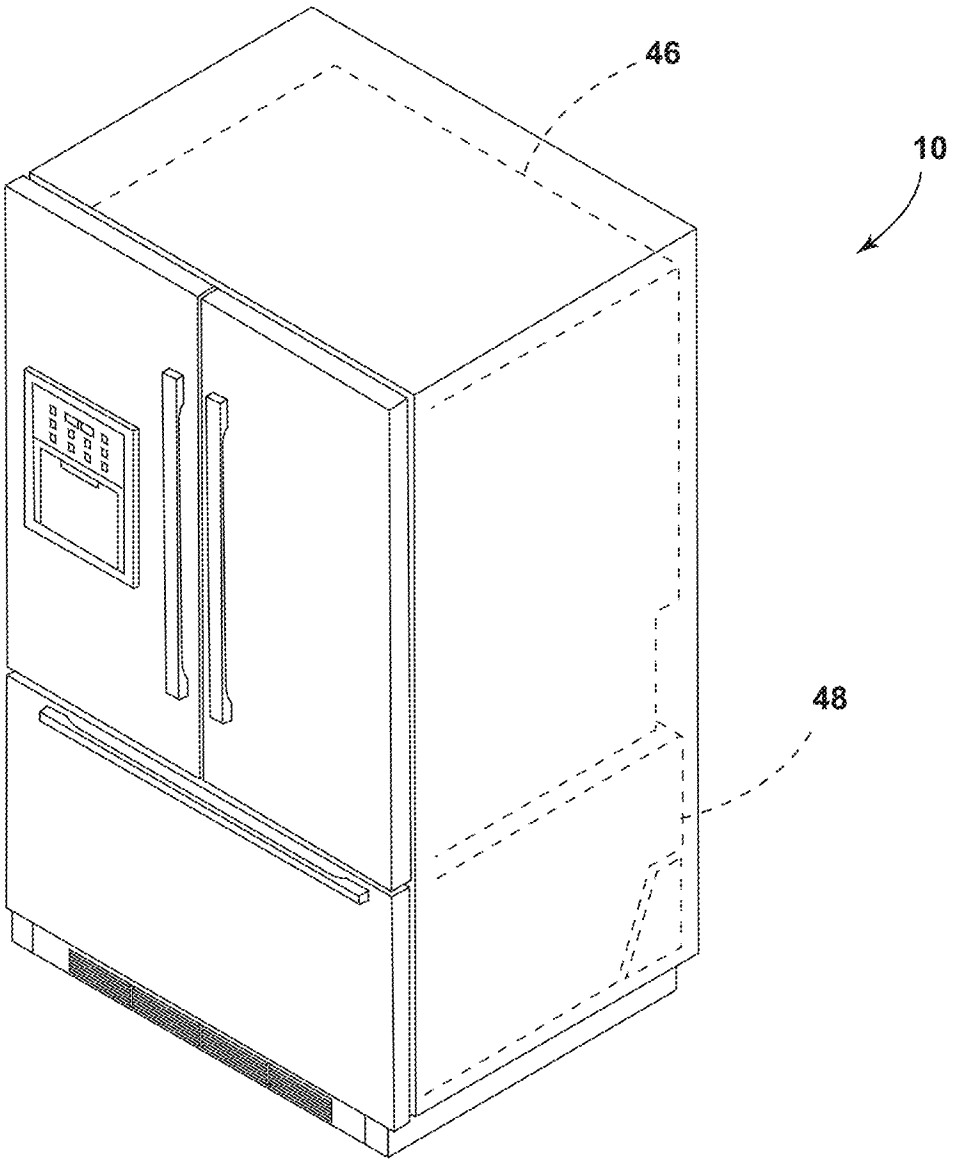
FIG. 1 is a top perspective view of a refrigeration unit.

The components in the figures are not necessarily to scale, emphasis instead being placed upon illustrating the principles described herein.

DETAILED DESCRIPTION

The present illustrated embodiments reside primarily in combinations of apparatus components related to a refrigeration unit. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

It is to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that an article or apparatus that comprises a list of elements does not include only those elements but may include other elements not expressly listed or inherent to such article or apparatus. An element proceeded by "comprises a . . . " does not, without more constraints, preclude the existence of additional identical elements in the article or apparatus that comprises the element.

Referring to FIGS. 1-7, reference numeral 10 generally designates a refrigeration unit. The refrigeration unit 10 includes a serpentine evaporator tube 12. The serpentine evaporator tube 12 includes a plurality of elongated portions 14 and a plurality of U-shaped bends 16 that connect the elongated portions 14. The refrigeration unit 10 further includes a heater tube 18. The heater tube 18 is in a spaced relationship with the serpentine evaporator tube 12. The heater tube 18 includes a bottom portion 20 that extends generally parallel to at least one of the plurality of elongated portions 14, and a side portion 22 that extends upward from the bottom portion 20 generally perpendicular to the at least one elongated portion 14. A wire 24 couples the at least one elongated portion 14 of the serpentine evaporator tube 12 to the bottom portion 20 of the heater tube 18. The wire 24 includes a first evaporator tube receiving section 26 that wraps about a portion of a circumference of the at least one elongated portion 14 of the serpentine evaporator tube 12. The wire 24 further includes a first heater tube receiving section 28 that wraps about a portion of a circumference of the bottom portion 20 of the heater tube 18. The wire 24 further includes a first spacer section 30 that extends between the first evaporator tube receiving section 26 and the first heater tube receiving section 28. The first spacer section 30 is configured to inhibit movement of the first evaporator tube receiving section 26 relative to the first heater tube receiving section 28. The first heater tube receiving section 28 contacts the at least one elongated portion 14 of the serpentine evaporator tube 12 and the first heater tube receiving section 28 contacts the bottom portion 20 of the heater tube 18, such that movement of the at least one elongated portion 14 of the serpentine evaporator tube 12 toward and away from the bottom portion 20 of the heater tube 18 is inhibited. The refrigeration unit 10 includes a bracket 32. The bracket 32 includes a first panel 34. The first panel 34 extends from a corner 36 to a contact surface 38 that is distal from the corner 36. The contact surface 38 is configured to contact the side portion 22 of the heater tube 18. A second panel 40 extends outward from the corner 36. The second panel 40 defines at least one aperture 42 and a recess 44. The at least one aperture 42 is configured to receive at least one of the plurality of U-shaped bends 16 of the serpentine evaporator tube 12 there through. The recess 44 is configured to receive the bottom portion 20 of the heater tube 18 therein.

Figure 2:
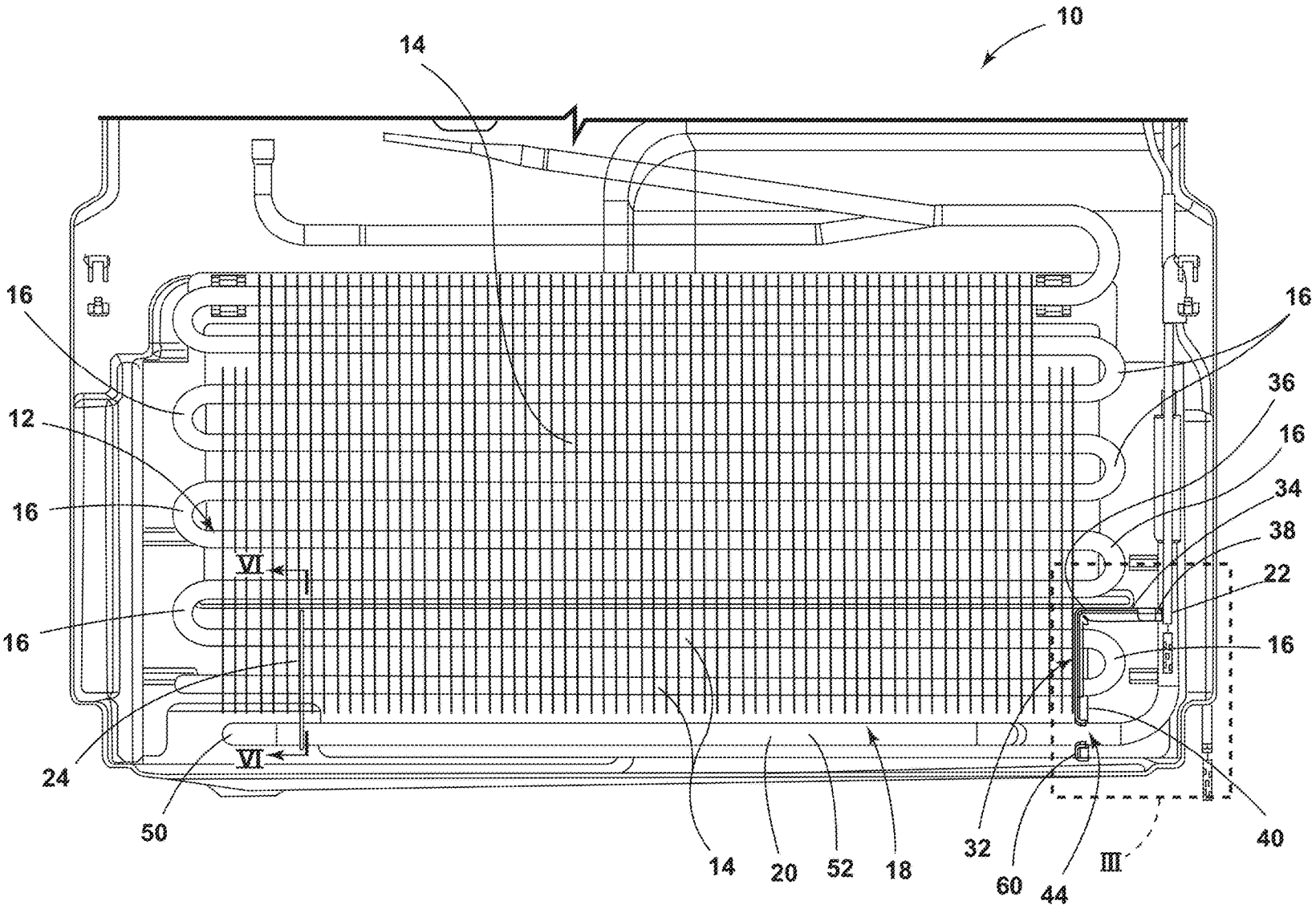
FIG. 2 is a rear elevational view of an interior portion of a refrigeration unit illustrating a heater tube held in a spaced relationship with an evaporator tube by a wire and a bracket.

Referring now to FIGS. 1 and 2, the refrigeration unit 10 is illustrated. In various implementations, the refrigeration unit 10 may include a refrigeration compartment 46 and/or a freezer compartment 48. The refrigeration unit 10 includes a refrigerant circuit (not shown) for cooling the refrigeration compartment 46 and/or the freezer compartment 48. The refrigerant circuit may include a compressor, a condenser, an expansion device, and the evaporator tube 12. In the embodiment illustrated in FIG. 2, the evaporator tube 12 of the refrigeration unit 10 is the serpentine evaporator tube 12. The serpentine evaporator tube 12 includes the plurality of elongated portions 14 and the plurality of U-shaped bends 16 that connect the elongated portions 14. As illustrated in FIG. 2, the plurality of elongated portions 14 extend substantially parallel to each other in generally horizontal directions between the plurality of U-shaped bends 16. A variety of types of refrigeration units 10 having various styles of evaporator tubes 12 are contemplated.

Figure 3:
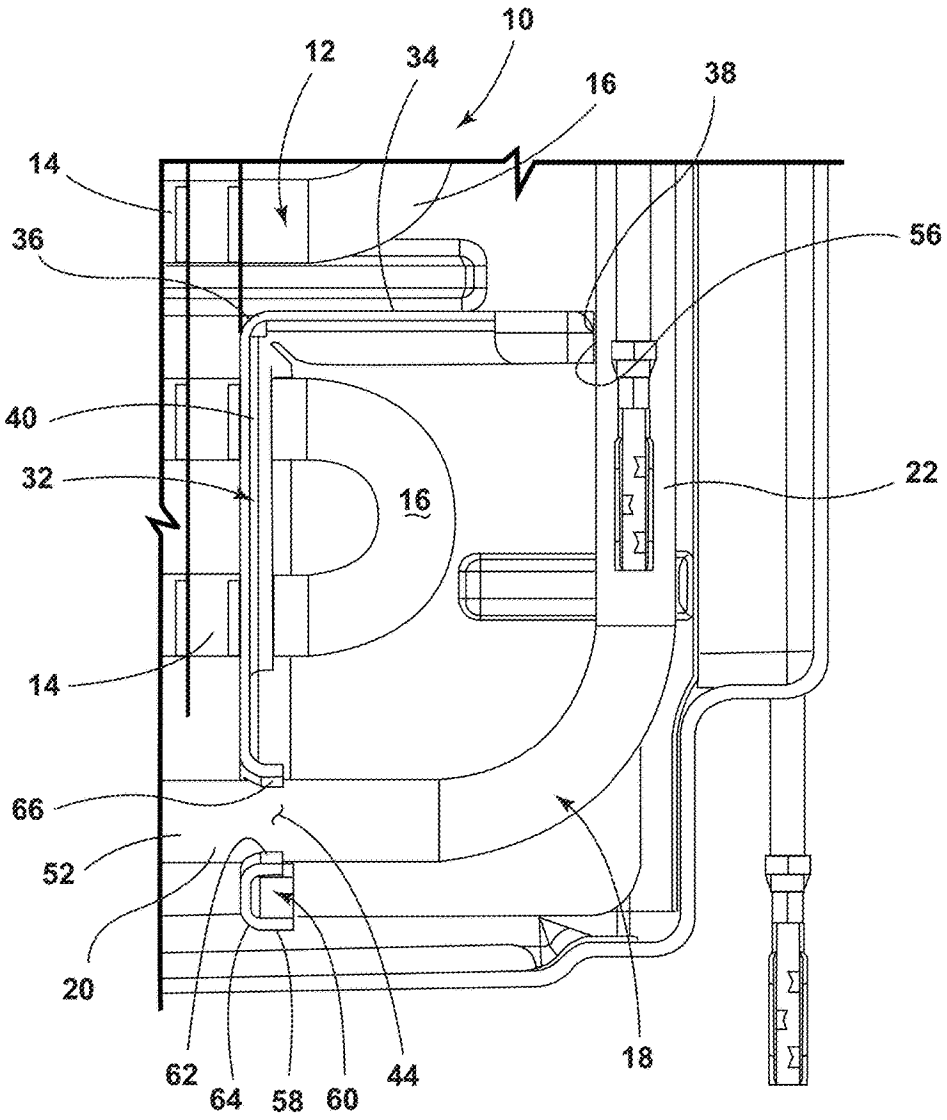
FIG. 3 is an enlarged rear elevational view of the bracket of FIG. 2 taken at area III.
Figure 4:
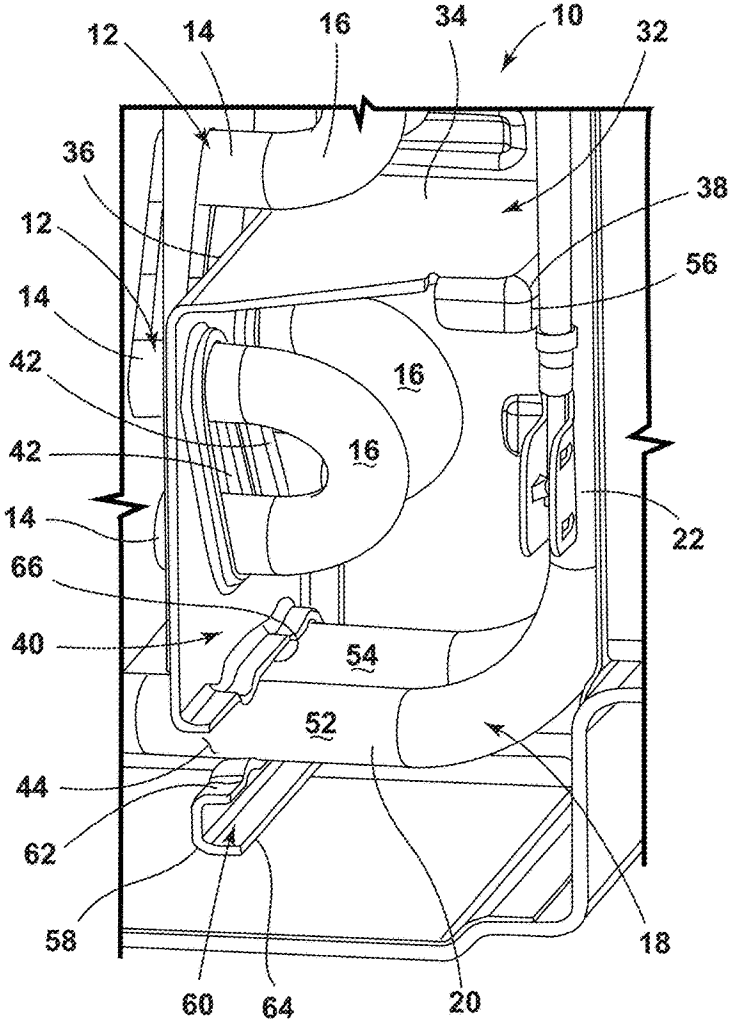
FIG. 4 is an enlarged top perspective view of an interior portion of a refrigeration unit illustrating a heater tube disposed within a recess defined by a bracket and U-shaped bends of an evaporator tube extending through apertures defined by the bracket.
Figure 6:
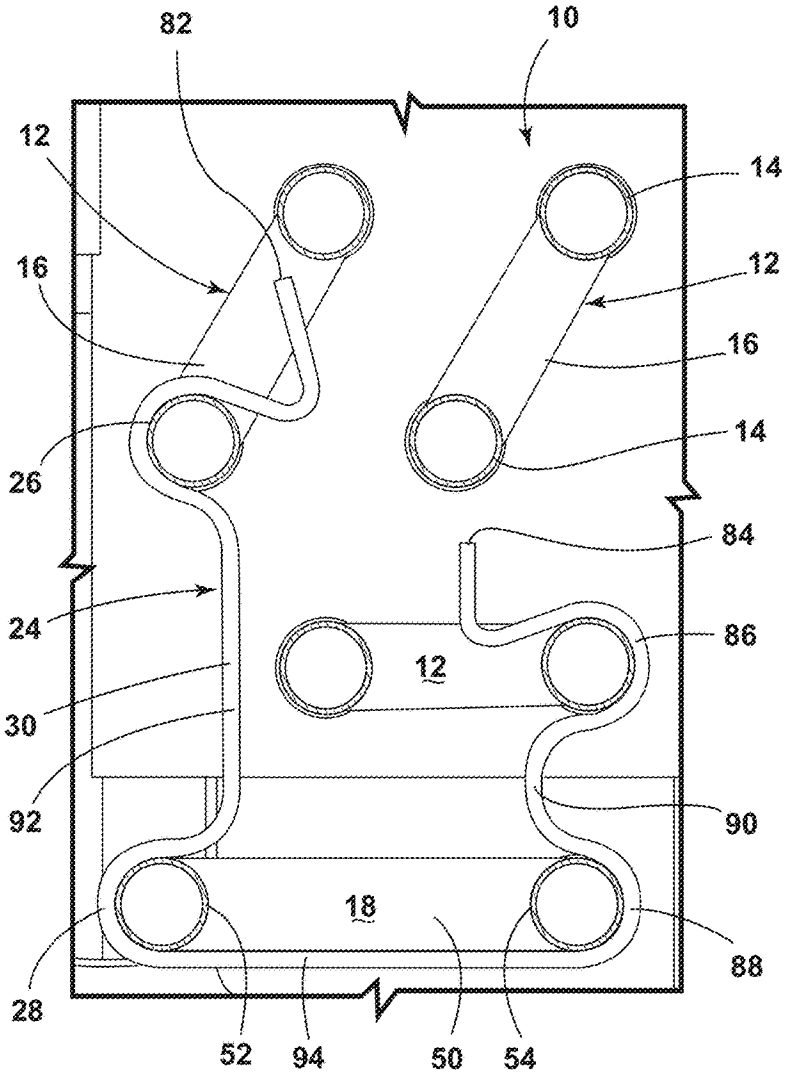
FIG. 6 is a cross-sectional view taken at line VI-VI of FIG. 2, illustrating the wire maintaining a spaced relationship between an evaporator tube and a heater tube.

Referring now to FIGS. 2-4 and 6, the refrigeration unit 10 includes the heater tube 18. The heater tube 18 may be configured to emanate heat to defrost or prevent frosting on the evaporator tube 12. For example, the heater tube 18 may be an aluminum or glass tube that is disposed about an electrical heating element. In various implementations, the heater tube 18 is configured to operate while in a spaced relationship with the evaporator tube 12. In the embodiment illustrated in FIG. 2, the heater tube 18 includes the bottom portion 20 that extends generally parallel to at least one of the plurality of elongated portions 14, and the side portion 22 that extends upward from the bottom portion 20 generally perpendicular to the at least one elongated portion 14. In the embodiment illustrated in FIG. 2, the bottom portion 20 is positioned refrigeration unit 10 downward of the evaporator tube 12, and the side portion 22 is positioned refrigeration unit 10 laterally-outboard of the serpentine evaporator tube 12. As illustrated in FIGS. 2 and 6, the bottom portion 20 of the heater tube 18 turns to form a U-shaped end portion 50 that is distal from the side portion 22 of the heater tube 18. As such, the bottom portion 20 and at least part of the side portion 22 of the heater tube 18 may include first and second heater tube extents 52, 54 that are connected by the U-shaped end portion 50. The first and second heater tube extents 52, 54 may extend outward from the U-shaped end portion 50 of the heater tube 18 generally parallel to each other, as illustrated in FIG. 4.

Referring now to FIGS. 2-5, the refrigeration unit 10 includes the bracket 32. The bracket 32 may be configured to maintain the heater tube 18 in a spaced relationship with the evaporator tube 12. As illustrated in FIGS. 2-5, the bracket 32 includes the first panel 34. The first panel 34 extends from the corner 36 to the contact surface 38 that is distal from the corner 36. In the embodiment illustrated in FIG. 4, the first panel 34 extends outward from the corner 36 and then folds downward to form a tang 56, which is the contact surface 38. The contact surface 38 is configured to contact the side portion 22 of the heater tube 18, as illustrated in FIGS. 2-4. In some implementations, the first panel 34 may extend outward from the corner 36 to the contact surface 38 in a direction that is generally parallel to the direction of extension of at least one of the plurality of elongated portions 14 of the serpentine evaporator tube 12 and/or the bottom portion 20 of the heater tube 18. As illustrated in FIG. 3, the first panel 34 may form a plane that is generally perpendicular to a direction of extension of the side portion 22 of the heater tube 18 that the contact surface 38 is configured to contact.

Referring still to FIGS. 2-5, the bracket 32 includes the second panel 40. The second panel 40 extends outward from the corner 36. In some examples, the first panel 34 extends from the corner 36 a first direction and the second panel 40 extends from the corner 36 a second direction, wherein the first direction is substantially perpendicular to the second direction. For example, as illustrated in FIG. 2, the second panel 40 extends outward from the corner 36 to a distal end 58 of the second panel 40 a direction that is generally perpendicular to the direction the first panel 34 extends from the corner 36 to the contact surface 38. In some implementations, the second panel 40 may extend outward from the corner 36 a direction that is generally perpendicular to the direction of extension of at least one of the plurality of elongated portions 14 of the serpentine evaporator tube 12 and/or the bottom portion 20 of the heater tube 18. As illustrated in FIG. 3, the second panel 40 may form a plane that is generally parallel to the direction of extension of the side portion 22 of the heater tube 18. The plane formed by the second panel 40 may be generally perpendicular to the plane formed by the first panel 34.

Figure 5:
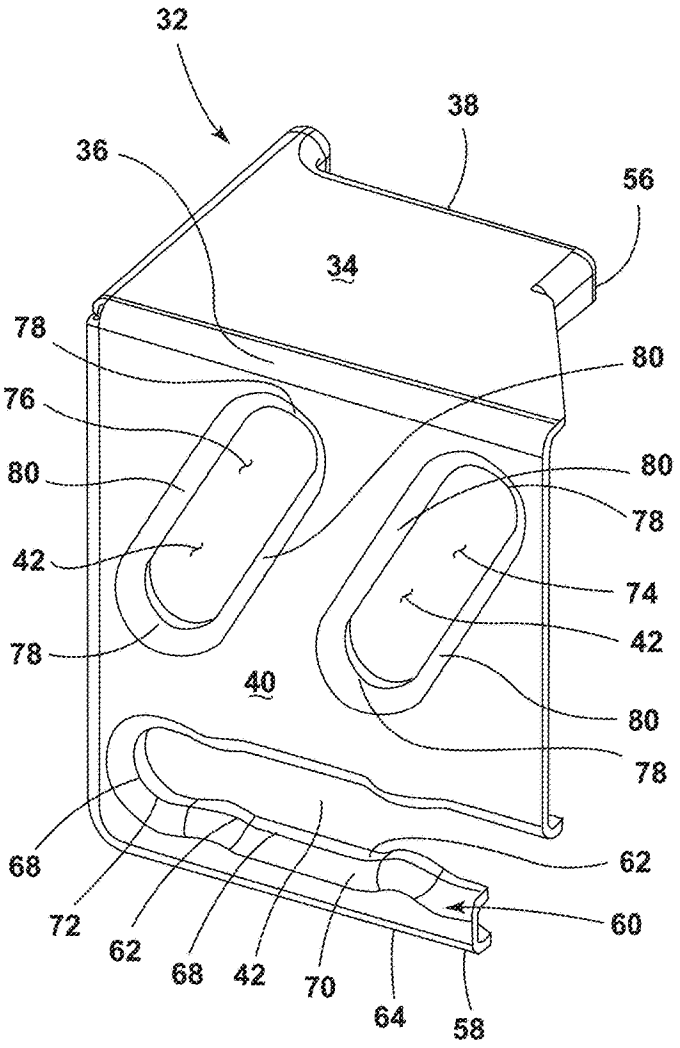
FIG. 5 is a top perspective view of a bracket illustrating first and second panels extending outward from a corner of the bracket.

Referring now to FIGS. 3-5, the second panel 40 may define the recess 44. The recess 44 may be configured to receive the bottom portion 20 of the heater tube 18 therein, as illustrated in FIGS. 3 and 4. In the embodiment illustrated in FIGS. 3-5, the second panel 40 includes a foot 60 that is positioned distally from the corner 36 of the bracket 32. The foot 60 includes a top side 62 that generally faces the corner 36 and a bottom side 64 that faces generally away from the corner 36. The bottom side 64 of the foot 60 is further than the top side 62 of the foot 60 from the corner 36 of the bracket 32. The bottom side 64 of the foot 60 may include the distal end 58 of the second panel 40. In various implementations, the top side 62 of the foot 60 defines the recess 44 of the second panel 40. For example, in the embodiment illustrated in FIG. 3, the recess 44 is defined by the top side 62 of the foot 60 together with a lower edge 66 of the portion of the second panel 40 positioned between the recess 44 and the corner 36 of the bracket 32.

Referring now to FIGS. 4 and 5, in some implementations, the top side 62 of the foot 60 may form at least one depression 68. For example, in the embodiment illustrated in FIG. 5, the top side 62 of the foot 60 forms first and second depressions 70, 72. The at least one depression 68 may be configured to cradle a portion of the circumference of the bottom portion 20 of the heater tube 18 therein. As illustrated in FIG. 4, the first heater tube extent 52 of the bottom portion 20 is cradled within the first depression 70, and the second heater tube extent 54 of the bottom portion 20 is cradled within the second depression 72. As illustrated in FIGS. 4 and 5, the lower edge 66 of the portion of the second panel 40 between the recess 44 and the corner 36 may also define at least one depression 68 configured to receive a portion of the circumference of the bottom portion 20 of the heater tube 18 therein.

Referring still to FIGS. 4 and 5, the second panel 40 of the bracket 32 defines at least one aperture 42, configured to receive at least one of the plurality of U-shaped bends 16 of the serpentine evaporator tube 12 there through. In various implementations, the second panel 40 of the bracket 32 defines a plurality of apertures 42. For example, as illustrated in FIGS. 4 and 5, the second panel 40 defines a first aperture 74 and a second aperture 76, each of which is configured to receive at least one of the plurality of U-shaped bends 16 there through. The at least one aperture 42 may be positioned between the corner 36 of the bracket 32 and the recess 44 defined by the second panel 40. In some examples, the at least one aperture 42 defined by the second panel 40 may be oblong. In other words, the at least one aperture 42 may have an elongated profile rather than a square or circular profile. In the embodiment illustrated in FIG. 5, the first and second apertures 74, 76 are generally stadium-shaped, having rounded ends 78 connected by elongated sides 80 that are generally parallel to each other. Shaping the at least one aperture 42 in this way may allow for at least one of the plurality of U-shaped bends 16 of the serpentine evaporator tube 12 to protrude through the at least one aperture 42, as illustrated in FIG. 4.

Figure 7:
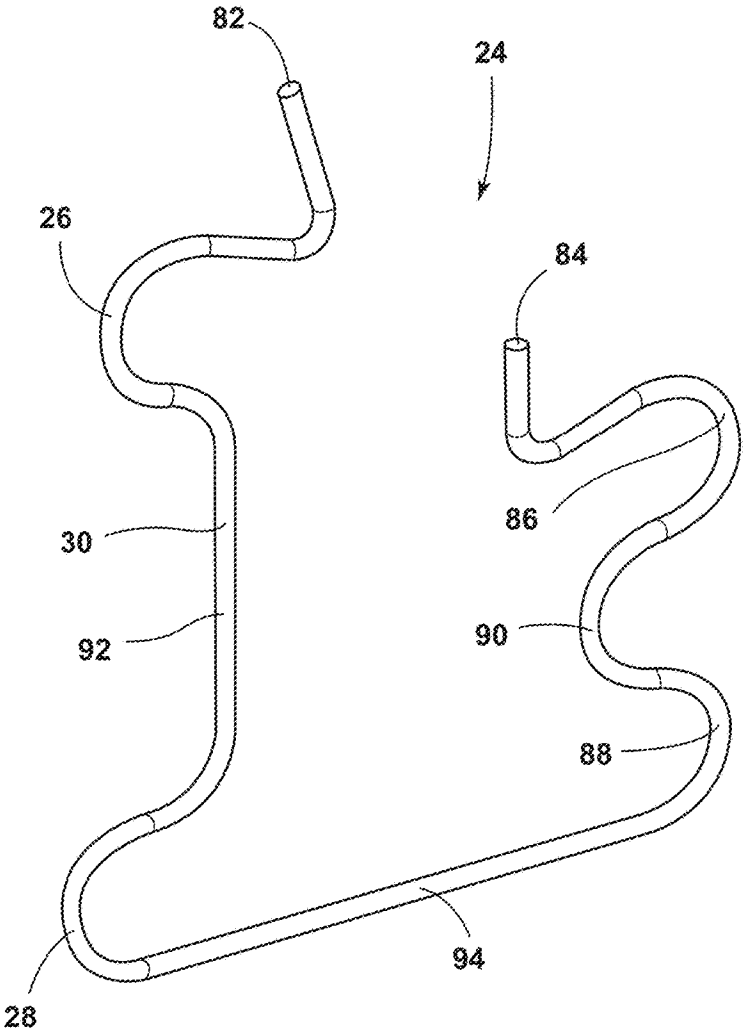
FIG. 7 is a top perspective view of a wire illustrating first and second evaporator tube receiving sections, first and second heater tube receiving sections, first and second spacer sections, and a connecting section.

Referring now to FIGS. 2, 6, and 7, the refrigeration unit 10 includes the wire 24. The wire 24 is configured to couple the evaporator tube 12 to the heater tube 18 and/or maintain a spaced relationship between the evaporator tube 12 and the heater tube 18. In some implementations, the wire 24 is configured to couple at least one of the elongated portions 14 of the serpentine evaporator tube 12 to the bottom portion 20 of the heater tube 18.

Referring now to FIGS. 6 and 7, the wire 24 extends from a first end 82 to a second end 84. In various implementations, the wire 24 may be shaped to form a plurality of receiving sections between the first and second ends 82, 84 of the wire 24. For example, the wire 24 may include the first evaporator tube receiving section 26 and the first heater tube receiving section 28. The first evaporator tube receiving section 26 may be configured to wrap about a portion of the circumference of the evaporator tube 12. As illustrated in FIG. 6, the first evaporator tube receiving section 26 wraps about a portion of the circumference of the elongated portion 14 of the serpentine evaporator tube 12. In some examples, the first heater tube receiving section 28 may be configured to wrap about a portion of a circumference of the heater tube 18. As illustrated in FIG. 6, the first heater tube receiving section 28 wraps about a portion of the circumference of the bottom portion 20 of the heater tube 18.

Referring still to FIGS. 6 and 7, the wire 24 includes the first spacer section 30. The first spacer section 30 extends between the first evaporator tube receiving section 26 and the first heater tube receiving section 28. The first spacer section 30 is configured to inhibit movement of the first evaporator tube receiving section 26 relative to the first heater tube receiving section 28. The first spacer section 30 may aid in maintaining a spaced relationship between the first evaporator tube receiving section 26 and the first heater tube receiving section 28 by inhibiting movement of the first evaporator tube receiving section 26 and the first heater tube receiving section 28 toward and/or away from each other. In some implementations, this inhibition of movement of the first evaporator tube receiving section 26 and the first heater tube receiving section 28 may aid in inhibiting movement of the heater tube 18 toward and/or away from the evaporator tube 12. As illustrated in FIG. 6, movement of the bottom portion 20 of the heater tube 18 toward and away from the elongated portion 14 of the serpentine evaporator tube 12 is inhibited due to contact between the first evaporator tube receiving section 26 and the evaporator tube 12 and contact between the first heater tube receiving section 28 and the heater tube 18, because the first spacer section 30 maintains the first evaporator tube and heater tube receiving sections 26, 28 in a spaced relationship.

In some examples, the first evaporator tube receiving section 26 may be nearer than the first heater tube receiving section 28 to the first end 82 of the wire 24. In some implementations, the first heater tube receiving section 28 and/or the first evaporator tube receiving section 26 may be substantially semicircular. For example, as illustrated in FIG. 6, the first evaporator tube receiving section 26 is substantially semicircular, such that first evaporator tube receiving section 26 wraps around about half of the circumference of the evaporator tube 12. As further illustrated in FIG. 6, the first heater tube receiving section 28 is substantially semicircular and wraps around about half of the circumference of the heater tube 18. First evaporator tube and heater tube receiving sections 26, 28 of various shapes are contemplated.

Referring now to FIGS. 6 and 7, in some implementations, the wire 24 may include a second evaporator tube receiving section 86 and/or a second heater tube receiving section 88. In the embodiments illustrated in FIGS. 6 and 7, the wire 24 includes first and second evaporator tube receiving sections 26, 86 and first and second heater tube receiving sections 28, 88. The first and second heater tube receiving sections 28, 88 are positioned between the first and second evaporator tube receiving sections 26, 86. As illustrated in FIG. 7, the first evaporator tube receiving section 26 is disposed proximate to the first end 82 of the wire 24, the second evaporator tube receiving section 86 is disposed proximate to the second end 84 of the wire 24, first heater tube receiving section 28 is positioned between the first and second evaporator tube receiving sections 26, 86, and the second heater tube receiving section 88 is positioned between the first heater tube receiving section 28 and the second evaporator tube receiving section 86.

In some implementations, the second heater tube receiving section 88 and/or the second evaporator tube receiving section 86 may be substantially semicircular. For example, as illustrated in FIG. 6, the second evaporator tube receiving section 86 is substantially semicircular, such that second evaporator tube receiving section 86 wraps around about half of the circumference of the evaporator tube 12. As further illustrated in FIG. 6, the second heater tube receiving section 88 is substantially semicircular and wraps around about half of the circumference of the heater tube 18. Second evaporator tube and heater tube receiving sections 86, 88 of various shapes are contemplated. As illustrated in FIG. 6, the first and second evaporator tube receiving sections 26, 86 respectively wrap about distinct elongated portions 14 of the serpentine evaporator tube 12, and the first and second heater tube receiving sections 28, 88 respectively wrap about the first and second heater tube extents 52, 54 of the bottom portion 20 of the heater tube 18.

As illustrated in FIGS. 6 and 7, the wire 24 includes a second spacer section 90. The second spacer section 90 extends between the second evaporator tube receiving section 86 and the second heater tube receiving section 88. The second spacer section 90 is configured to inhibit movement of the second evaporator tube receiving section 86 relative to the second heater tube receiving section 88. The second spacer section 90 may aid in maintaining a spaced relationship between the second evaporator tube receiving section 86 and the second heater tube receiving section 88 by inhibiting movement of the second evaporator tube receiving section 86 and the second heater tube receiving section 88 toward and/or away from each other. In some implementations, this inhibition of movement of the second evaporator tube receiving section 86 and the second heater tube receiving section 88 may aid in inhibiting movement of the heater tube 18 toward and/or away from the evaporator tube 12. As illustrated in FIG. 6, movement of the bottom portion 20 of the heater tube 18 toward and away from the elongated portion 14 of the serpentine evaporator tube 12 is inhibited due to contact between the second evaporator tube receiving section 86 and the evaporator tube 12 and contact between the second heater tube receiving section 88 and the heater tube 18, because the second spacer section 90 maintains the second evaporator tube and heater tube receiving sections 86, 88 in a spaced relationship.

Referring still to FIGS. 6 and 7, in some implementations, the first heater tube receiving section 28 is a first distance from the first evaporator tube receiving section 26, and the second heater tube receiving section 88 is a second distance from the second evaporator tube receiving section 86, wherein the first distance is greater than the second distance. In other words, the first heater tube receiving section 28 may be distanced further from the first evaporator tube receiving section 26 than the second heater tube receiving section 88 is distanced from the second evaporator tube receiving section 86, as illustrated in FIGS. 6 and 7. In the illustrated embodiments, the second spacer section 90 is generally arcuate, while the first spacer section 30 includes an elongated linear portion 92 that contributes to the difference in distance between the first evaporator tube and heater tube receiving sections 26, 28 and the second evaporator tube and heater tube receiving sections 86, 88, respectively.

Referring still to FIGS. 6 and 7, the wire 24 includes a connecting section 94. The connecting section 94 extends between the first and second heater tube receiving sections 28, 88. In some implementations, the connecting section 94 of the wire 24 may be substantially linear. For example, in the embodiment illustrated in FIG. 6, the connecting section 94 extends substantially linearly from the first heater tube receiving section 28 to the second heater tube receiving section 88 in a direction that is substantially perpendicular to the linear portion 92 of the first spacer section 30.

The wire and bracket as described in the present disclosure may provide a variety of advantages. First, the wire 24 may inhibit movement of the evaporator tube 12 and heater tube 18 both toward and away from each other, such that the heater tube 18 may be supported by the wire 24 in an upright position of the refrigeration unit 10, wherein the bottom portion 20 of the heater tube 18 is below the evaporator tube 12, and the heater tube 18 may be restrained by the wire 24 from moving toward and contacting the evaporator tube 12 in the event that the refrigeration unit 10 topples over or is moved to a non-upright position. Second, the bracket 32 is operable to support the bottom portion 20 of the heater tube 18 via the foot 60 defining the recess 44 in the second panel 40 when the refrigeration unit 10 is in the upright position, and the bracket 32 is operable to restrain movement of the bottom portion 20 of the heater tube 18 toward the evaporator tube 12 via the lower edge 66 that defines the recess 44 of the second panel 40 in the event that the refrigeration unit 10 enters a non-upright position. Third, the contact surface 38 of the first panel 34 of the bracket 32 is operable to restrain movement of the side portion 22 of the heater tube 18 toward the evaporator tube 12 to prevent contact between the evaporator tube 12 and the heater tube 18, which may result in undesirable outcomes, such as deformation of the evaporator tube 12.

According to one aspect of the present disclosure, a refrigeration unit is disclosed. The refrigeration unit includes a serpentine evaporator tube having a plurality of elongated portions and a plurality of U-shaped bends that connect the elongated portions, a heater tube in a spaced relationship with the serpentine evaporator tube, a wire that couples the at least one elongated portion of the serpentine evaporator tube to the bottom portion of the heater tube, and a bracket. The heater tube includes a bottom portion that extends generally parallel to at least one of the plurality of elongated portions and a side portion that extends upward from the bottom portion generally perpendicular to the at least one elongated portion. The wire includes a first evaporator tube receiving section that wraps about a portion of a circumference of the at least one elongated portion of the serpentine evaporator tube, a first heater tube receiving section that wraps about a portion of a circumference of the bottom portion of the heater tube, and a first spacer section that extends between the first evaporator tube receiving section and the first heater tube receiving section and is configured to inhibit movement of the first evaporator tube receiving section relative to the first heater tube receiving section. The first evaporator tube receiving section contacts the at least one elongated portion of the serpentine evaporator tube and the first heater tube receiving section contacts the bottom portion of the heater tube, such that movement of the bottom portion of the heater tube toward and away from the at least one elongated portion of the serpentine evaporator tube is inhibited. The bracket includes a first panel that extends from a corner to a contact surface that is distal from the corner and configured to contact the side portion of the heater tube and a second panel that extends outward from the corner. The second panel defines at least one aperture configured to receive at least one of the plurality of U-shaped bends of the serpentine evaporator tube there through and a recess configured to receive the bottom portion of the heater tube therein.

According to another aspect, the wire further includes a second heater tube receiving section that wraps about a portion of the circumference of the bottom portion of the heater tube, a connecting section that extends between the first and second heater tube receiving sections, a second evaporator tube receiving section that wraps about a portion of the circumference of the at least one elongated portion of the serpentine evaporator tube, and a second spacer section that extends between the second evaporator tube receiving section and the second heater tube receiving section and is configured to inhibit movement of the second evaporator tube receiving section relative to the second heater tube receiving section.

According to yet another aspect, the first heater tube receiving section is a first distance from the first evaporator tube receiving section, and the second heater tube receiving section is a second distance from the second evaporator tube receiving section. The first distance is greater than the second distance.

According to still another aspect, the wire extends from a first end to a second end. The first evaporator tube receiving section is disposed proximate to the first end, the second evaporator tube receiving section is disposed proximate to the second end, and the first and second heater tube receiving sections are positioned between the first and second evaporator tube receiving sections.

According to another aspect, the first evaporator tube receiving section is substantially semicircular, and the first heater tube receiving section is substantially semicircular.

According to yet another aspect, the first panel extends from the corner a first direction and the second panel extends from the corner a second direction. The first direction is substantially perpendicular to the second direction.

According to still another aspect, the at least one aperture defined by the second panel is positioned between the corner and the recess.

According to another aspect, the second panel includes a foot positioned distally from the corner. The foot has a top side that defines the recess and a bottom side that is further than the top side from the corner.

According to yet another aspect, the top side of the foot defines at least one depression configured to cradle a portion of the circumference of the bottom portion of the heater tube.

According to another aspect, the at least one aperture defined by the second panel is oblong.

According to another aspect of the present disclosure, a wire for coupling an evaporator tube to a heater tube is disclosed. The wire includes a first evaporator tube receiving section configured to wrap about a portion of a circumference of said evaporator tube, a first heater tube receiving section configured to wrap about a portion of a circumference of said heater tube, and a first spacer section that extends between the first evaporator tube receiving section and the first heater tube receiving section and inhibits movement of the first evaporator tube receiving section relative to the first heater tube receiving section. The first evaporator tube receiving section is configured to contact said evaporator tube and the first heater tube receiving section is configured to contact said heater tube, such that movement of said heater tube toward and away from said evaporator tube is inhibited.

According to another aspect, a second heater tube receiving section is configured to wrap about a portion of the circumference of said heater tube, a connecting section extends between the first and second heater tube receiving sections, a second evaporator tube receiving section is configured to wrap about a portion of the circumference of said evaporator tube, and a second spacer section extends between the second evaporator tube receiving section and the second heater tube receiving section and is configured to inhibit movement of the second evaporator tube receiving section relative to the second heater tube receiving section.

According to yet another aspect, the first heater tube receiving section is a first distance from the first evaporator tube receiving section, and the second heater tube receiving section is a second distance from the second evaporator tube receiving section. The first distance is greater than the second distance.

According to still another aspect, the wire extends from a first end to a second end. The first evaporator tube receiving section is disposed proximate to the first end, the second evaporator tube receiving section is disposed proximate to the second end, and the first and second heater tube receiving sections are positioned between the first and second evaporator tube receiving sections.

According to another aspect, the first evaporator tube receiving section is substantially semicircular, and the first heater tube receiving section is substantially semicircular.

According to another aspect of the present disclosure, a refrigeration unit is disclosed. The refrigeration unit includes a serpentine evaporator tube having a plurality of elongated portions and a plurality of U-shaped bends that connect the elongated portions, a heater tube in a spaced relationship with the serpentine evaporator tube, and a bracket. The heater tube includes a bottom portion that extends generally parallel to at least one of the plurality of elongated portions and a side portion that extends upward from the bottom portion generally perpendicular to the at least one elongated portion. The bracket includes a first panel that extends from a corner to a contact surface that is distal from the corner and configured to contact the side portion of the heater tube and a second panel that extends outward from the corner. The second panel defines at least one aperture configured to receive at least one of the plurality of U-shaped bends of the serpentine evaporator tube there through, and a recess configured to receive the bottom portion of the heater tube therein.

According to yet another aspect, the first panel extends from the corner a first direction and the second panel extends from the corner a second direction. The first direction is substantially perpendicular to the second direction.

According to yet another aspect, the at least one aperture defined by the second panel is positioned between the corner and the recess.

According to still another aspect, the second panel includes a foot positioned distally from the corner. The foot has a top side that defines the recess and a bottom side that is further than the top side from the corner.

According to another aspect, the top side of the foot defines at least one depression configured to cradle a portion of a circumference of the bottom portion of the heater tube.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A refrigeration unit, comprising:

a serpentine evaporator tube having a plurality of elongated portions, including a first elongated portion and a second elongated portion, and a plurality of U-shaped bends that connect the elongated portions;

a heater tube in a spaced relationship with the serpentine evaporator tube and comprising:

a bottom portion that includes first and second heater tube extents that are connected by a U-shaped end portion and that extend generally parallel to at least one of the plurality of elongated portions; and a side portion that extends upward from the bottom portion generally perpendicular to the at least one of the plurality of elongated portions;

a wire that couples the serpentine evaporator tube to the bottom portion of the heater tube, the wire comprising:

a first evaporator tube receiving section that wraps about a portion of a circumference of the first elongated portion of the serpentine evaporator tube;

a second evaporator tube receiving section that wraps about a portion of a circumference of the second elongated portion of the serpentine evaporator tube;

a first heater tube receiving section that wraps about a portion of a circumference of the first heater tube extent of the bottom portion of the heater tube;

a second heater tube receiving section that wraps about a portion of a circumference of the second heater tube extent; and a first spacer section that extends between the first evaporator tube receiving section and the first heater tube receiving section and is configured to inhibit movement of the first evaporator tube receiving section relative to the first heater tube receiving section, wherein the first evaporator tube receiving section contacts the first elongated portion of the serpentine evaporator tube and the first heater tube receiving section contacts the bottom portion of the heater tube, such that movement of the bottom portion of the heater tube toward and away from the first elongated portion of the serpentine evaporator tube is inhibited; and a bracket comprising:

a first panel that extends from a corner to a contact surface that is distal from the corner and configured to contact the side portion of the heater tube; and a second panel that extends outward from the corner, wherein the second panel defines at least one aperture configured to receive at least one of the plurality of U-shaped bends of the serpentine evaporator tube there through, and a recess configured to receive the bottom portion of the heater tube therein.

2. The refrigeration unit of claim 1, wherein the wire further comprises:

a connecting section that extends between the first and second heater tube receiving sections; and a second spacer section that extends between the second evaporator tube receiving section and the second heater tube receiving section and is configured to inhibit movement of the second evaporator tube receiving section relative to the second heater tube receiving section.

3. The refrigeration unit of claim 2, wherein the first heater tube receiving section is a first distance from the first evaporator tube receiving section, and the second heater tube receiving section is a second distance from the second evaporator tube receiving section, and wherein the first distance is greater than the second distance.

4. The refrigeration unit of claim 2, wherein the wire extends from a first end to a second end, and wherein the first evaporator tube receiving section is disposed proximate to the first end, the second evaporator tube receiving section is disposed proximate to the second end, and the first and second heater tube receiving sections are positioned between the first and second evaporator tube receiving sections.

5. The refrigeration unit of claim 1, wherein the first evaporator tube receiving section is substantially semicircular, and the first heater tube receiving section is substantially semicircular.

6. The refrigeration unit of claim 1, wherein the first panel extends from the corner a first direction and the second panel extends from the corner a second direction, wherein the first direction is substantially perpendicular to the second direction.

7. The refrigeration unit of claim 1, wherein the at least one aperture defined by the second panel is positioned between the corner and the recess.

8. The refrigeration unit of claim 1, wherein the second panel comprises:

a foot positioned distally from the corner, the foot having a top side that defines the recess and a bottom side that is further than the top side from the corner.

9. The refrigeration unit of claim 8, wherein the top side of the foot defines at least one depression configured to cradle a portion of the circumference of the bottom portion of the heater tube.

10. The refrigeration unit of claim 1, wherein the at least one aperture defined by the second panel is oblong.

11. A wire for coupling an evaporator tube to a heater tube, the wire comprising:

a first evaporator tube receiving section configured to wrap about a portion of a circumference of said evaporator tube;

a second evaporator tube receiving section configured to wrap about a portion of a circumference of said evaporator tube;

a first heater tube receiving section configured to wrap about a portion of a circumference of said heater tube;

a second heater tube receiving section configured to wrap about a portion of a circumference of said heater tube;

a first spacer section that extends between the first evaporator tube receiving section and the first heater tube receiving section and inhibits movement of the first evaporator tube receiving section relative to the first heater tube receiving section, wherein the first evaporator tube receiving section is configured to contact said evaporator tube and the first heater tube receiving section is configured to contact said heater tube, such that movement of said heater tube toward and away from said evaporator tube is inhibited; and a second spacer section that extends between the second evaporator tube receiving section and the second heater tube receiving section and inhibits movement of the second evaporator tube receiving section relative to the second heater tube receiving section, wherein the first heater tube receiving section is a first distance from the first evaporator tube receiving section, and the second heater tube receiving section is a second distance from the second evaporator tube receiving section, and wherein the first distance is greater than the second distance.

12. The wire of claim 11, further comprising:

a connecting section that extends between the first and second heater tube receiving sections.

13. The wire of claim 12, wherein said wire extends from a first end to a second end, and wherein the first evaporator tube receiving section is disposed proximate to the first end, the second evaporator tube receiving section is disposed proximate to the second end, and the first and second heater tube receiving sections are positioned between the first and second evaporator tube receiving sections.

14. The wire of claim 11, wherein the first evaporator tube receiving section is substantially semicircular, and the first heater tube receiving section is substantially semicircular.

15. A refrigeration unit, comprising:

a serpentine evaporator tube having a plurality of elongated portions and a plurality of U-shaped bends that connect the plurality of elongated portions;

a heater tube in a spaced relationship with the serpentine evaporator tube and comprising:

a bottom portion that extends generally parallel to at least one elongated portion of the plurality of elongated portions; and a side portion that extends upward from the bottom portion generally perpendicular to the at least one elongated portion; and a bracket comprising:

a first panel that extends from a corner to a contact surface that is distal from the corner and configured to contact the side portion of the heater tube; and a second panel that extends outward from the corner, wherein the second panel defines at least one aperture configured to receive at least one U-shaped bend of the plurality of U-shaped bends of the serpentine evaporator tube therethrough, and a recess configured to receive the bottom portion of the heater tube therein, and wherein the first panel forms the upward-most portion of the bracket and extends outward from the corner over the at least one U-shaped bend, such that the first panel is positioned above the at least one U-shaped bend.

16. The refrigeration unit of claim 15, wherein the first panel extends from the corner in a first direction and the second panel extends from the corner in a second direction, and wherein the first direction is substantially perpendicular to the second direction.

17. The refrigeration unit of claim 15, wherein the at least one aperture defined by the second panel is positioned between the corner and the recess.

18. The refrigeration unit of claim 15, wherein the second panel comprises:

a foot positioned distally from the corner, the foot having a top side that defines the recess and a bottom side that is further than the top side from the corner.

19. The refrigeration unit of claim 18, wherein the top side of the foot defines at least one depression configured to cradle a portion of a circumference of the bottom portion of the heater tube.

* * * * *